US010411374B2

(12) United States Patent
Tanaka et al.

(10) Patent No.: US 10,411,374 B2
(45) Date of Patent: Sep. 10, 2019

(54) CABLE CONNECTION STRUCTURAL BODY AND CABLE CONNECTOR

(71) Applicant: Japan Aviation Electronics Industry, Limited, Tokyo (JP)

(72) Inventors: Yukitaka Tanaka, Tokyo (JP); Chikara Kawamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/630,492

(22) Filed: Jun. 22, 2017

(65) Prior Publication Data

US 2018/0097300 A1 Apr. 5, 2018

(30) Foreign Application Priority Data

Sep. 30, 2016 (JP) ..... 2016-193569

(51) Int. Cl.

| | |
|---|---|
| ***H01R 4/66*** | (2006.01) |
| ***H01R 12/53*** | (2011.01) |
| ***H01R 9/03*** | (2006.01) |
| *H01R 13/6594* | (2011.01) |

(52) U.S. Cl.

CPC ..... *H01R 12/53* (2013.01); *H01R 9/03* (2013.01); *H01R 9/034* (2013.01); *H01R 13/6594* (2013.01)

(58) Field of Classification Search

CPC .... H01R 4/64; H01R 13/65802; H01R 4/646; H01R 23/662; H01R 23/6873; H01R 13/658

USPC ... 439/92, 95, 98, 492, 497, 607.28, 607.35, 439/607.41, 607.46, 607.49

See application file for complete search history.

(56) References Cited

U.S. PATENT DOCUMENTS

| | | | | |
|---|---|---|---|---|
| 3,686,609 | A * | 8/1972 | Hansen | H01R 4/64 24/350 |
| 3,910,663 | A * | 10/1975 | Winger | H01R 4/64 439/82 |
| 6,276,947 | B1 * | 8/2001 | Homfeldt | H01R 4/48 439/444 |
| 6,489,563 | B1 * | 12/2002 | Zhao | H01R 9/0524 174/880 |
| 6,939,174 | B2 * | 9/2005 | Wu | H01R 13/514 439/607.05 |
| 7,503,776 | B1 * | 3/2009 | Pavlovic | H01R 4/46 439/455 |
| 7,686,625 | B1 * | 3/2010 | Dyer | H01R 4/64 439/857 |
| 7,819,675 | B2 * | 10/2010 | Ko | H01R 9/034 439/98 |

(Continued)

FOREIGN PATENT DOCUMENTS

| | | |
|---|---|---|
| CN | 205104699 U | 3/2016 |
| JP | 2014-132588 A | 7/2014 |

*Primary Examiner* — Thanh Tam T Le

(74) *Attorney, Agent, or Firm* — Muncy, Geissler, Olds & Lowe, P.C.

(57) ABSTRACT

A cable connection structural body is used for connecting a multi-core cable having a plurality of signal lines to a substrate, and the cable connection structural body includes a substrate fixation portion that is fixed to the substrate, and a cable holding portion that forms a space passing the plurality of signal lines therethrough between the cable holding portion and a surface of the substrate when the substrate fixation portion is fixed to the substrate.

12 Claims, 4 Drawing Sheets

(56) References Cited

U.S. PATENT DOCUMENTS

| | | | | |
|---|---|---|---|---|
| 8,002,575 | B2 * | 8/2011 | Li | H01R 9/03 439/465 |
| 8,298,009 | B2 * | 10/2012 | Elkhatib | H01R 12/594 439/581 |
| 8,337,243 | B2 * | 12/2012 | Elkhatib | H01R 12/594 439/581 |
| 8,758,051 | B2 * | 6/2014 | Nonen | H01R 4/023 174/88 R |
| 8,840,432 | B2 * | 9/2014 | Alden, III | H01R 13/648 439/607.35 |
| 9,035,183 | B2 * | 5/2015 | Kodama | H05K 1/18 174/74 R |
| 9,203,193 | B2 * | 12/2015 | Hackman | H01R 13/648 |
| 9,373,915 | B1 * | 6/2016 | Schulz | H01R 13/6594 |
| 2017/0040746 | A1 | 2/2017 | Zhang et al. | |

* cited by examiner

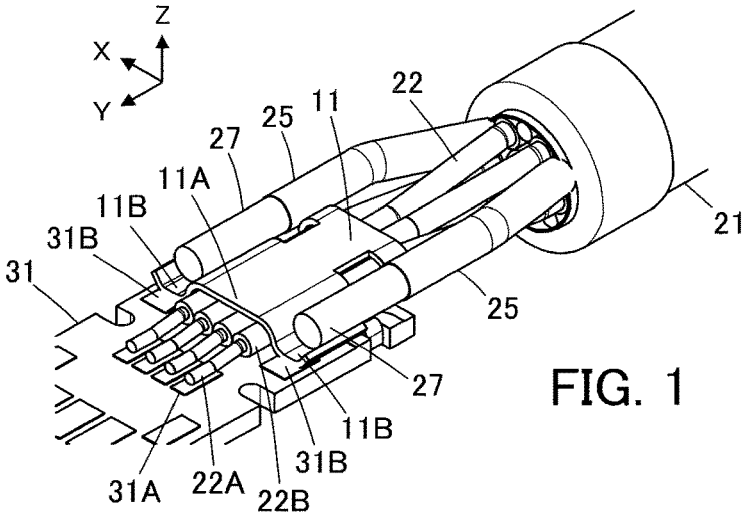
FIG. 1
FIG. 2
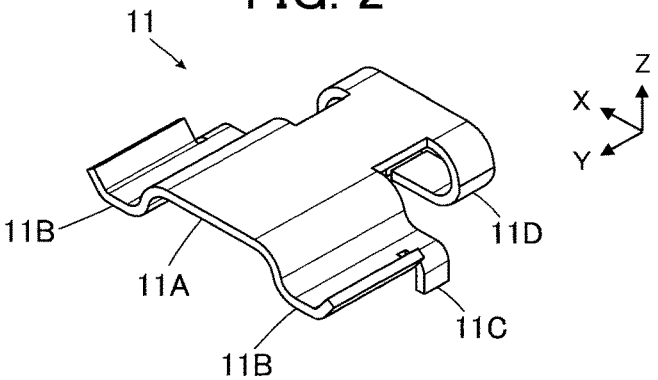
FIG. 3
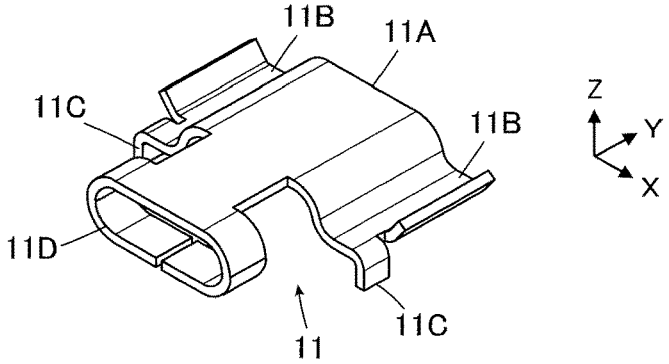

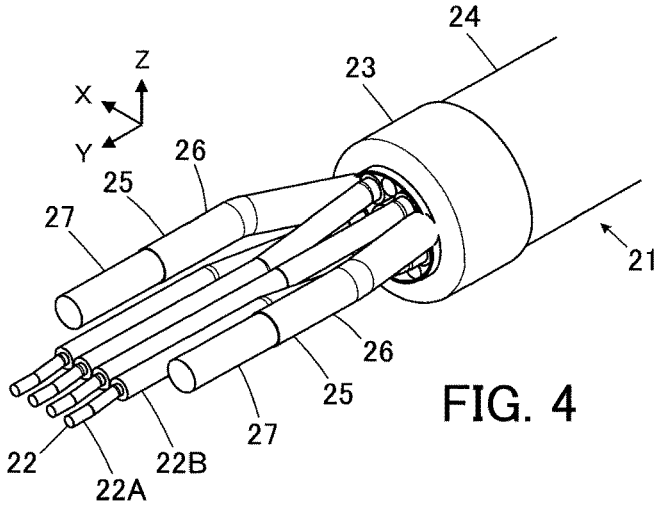
FIG. 4
FIG. 5
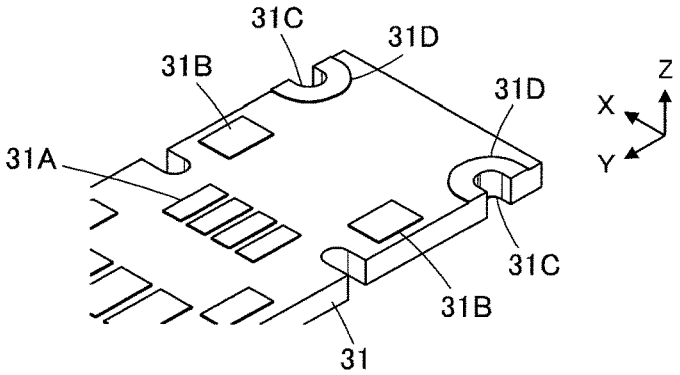
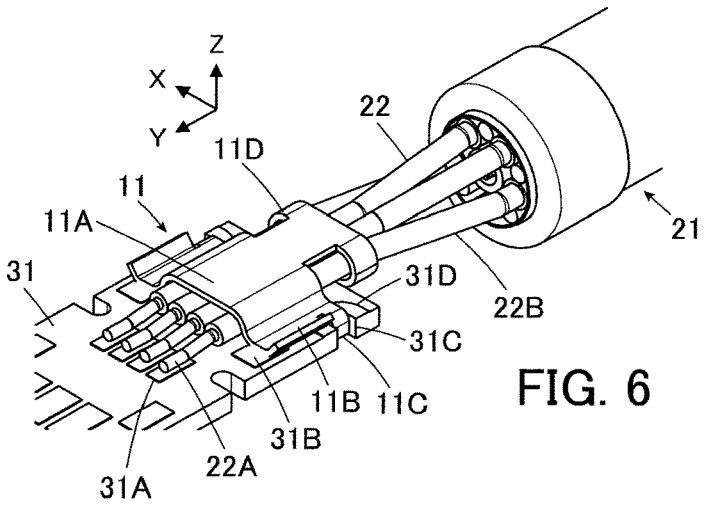
FIG. 6

CABLE CONNECTION STRUCTURAL BODY AND CABLE CONNECTOR

BACKGROUND OF THE INVENTION

The present invention relates to a cable connection structural body, particularly to a cable connection structural body that is used for connecting a multi-core cable having a plurality of signal lines to a substrate.

The present invention also relates to a cable connector that establishes connection of a multi-core cable using a cable connection structural body.

As a cable connection structure used for connecting a multi-core cable to a substrate, for instance, JP 2014-132588 A discloses the structure in which central conductors 3 of a plurality of coaxial cables 2 of a multi-core cable 1 are separately connected to corresponding signal electrodes 5 of a substrate 4 by soldering and external conductors 6 of the coaxial cables 2 are connected to a ground electrode 7 of the substrate 4 by soldering, as shown in FIG. 13.

When the multi-core cable 1 is connected to the substrate 4, internal insulators 8 disposed between the central conductors 3 and the external conductors 6 of the relevant coaxial cables 2 are first positioned by being attached onto a surface of the substrate 4 at a position between the signal electrodes 5 and the ground electrode 7 by a positioning means 9 such as an adhesive or a double-sided adhesive tape. In this state, the central conductors 3 of the coaxial cables 2 are arranged at an arrangement pitch of the signal electrodes 5 of the substrate 4 and connected to the corresponding signal electrodes 5 by soldering, and in addition, the external conductors 6 of the coaxial cables 2 are connected to the ground electrode 7 of the substrate 4 by soldering.

By thus positioning the internal insulators 8 of the coaxial cables 2, it is possible to perform solder connection of the central conductors 3 and the external conductors 6 of the coaxial cables 2 while preventing misalignment of the coaxial cables 2.

Since, however, the internal insulators 8 of the coaxial cables 2 need to be attached to the surface of the substrate 4 by using the positioning means 9 such as an adhesive or a double-sided adhesive tape, the positioning process requires much time and work, which makes the whole connecting operation complicated.

SUMMARY OF THE INVENTION

The present invention has been made to solve the conventional problem as above and is aimed at providing a cable connection structural body that enables easy connection of a multi-core cable while preventing misalignment of a plurality of signal lines of the multi-core cable.

The present invention is also aimed at providing a cable connector having such a cable connection structural body.

The present invention provides a cable connection structural body that is used for connecting a multi-core cable having a plurality of signal lines to a substrate, the cable connection structural body comprising a substrate fixation portion that is fixed to the substrate, and a cable holding portion that forms a space passing the plurality of signal lines therethrough between the cable holding portion and a surface of the substrate when the substrate fixation portion is fixed to the substrate.

A cable connector according to the invention comprises the cable connection structural body.

BRIEF DESCRIPTION OF THE DRAWINGS

FIG. 1 is a perspective view showing a cable connection structure for connecting a multi-core cable to a substrate using a cable connection structural body according to Embodiment 1 of the invention.

FIG. 2 is a perspective view showing the cable connection structural body according to Embodiment 1.

FIG. 3 is a perspective view showing the cable connection structural body according to Embodiment 1 as viewed from the direction opposite to the viewing direction in FIG. 2.

FIG. 4 is a partial perspective view showing an end portion of the multi-core cable.

FIG. 5 is a partial perspective view showing the substrate to be connected with the multi-core cable.

FIG. 6 is a perspective view showing the state where the multi-core cable is being connected to the substrate using the cable connection structural body according to Embodiment 1.

DETAILED DESCRIPTION OF THE INVENTION

Figure 7:
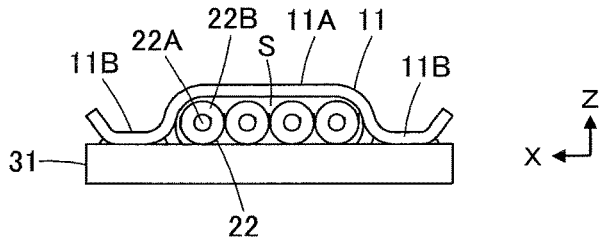
FIG. 7 is a front view showing the state where a plurality of signal lines of the multi-core cable are passed between a cable holding portion of the cable connection structural body according to Embodiment 1 and the substrate.

Embodiments of the present invention are described below based on the appended drawings.

Embodiment 1

A cable connection structure using a cable connection structural body 11 according to Embodiment 1 is shown in FIG. 1. A multi-core cable 21 is connected to a substrate 31 using the cable connection structural body 11.

For convenience, it is assumed that a surface of the substrate 31 extends along an XY plane, with the direction from the multi-core cable 21 toward the substrate 31 being called "+Y direction" and the direction perpendicular to the surface of the substrate 31 being called "Z direction", and that the cable connection structural body 11 lies on the surface of the substrate 31 on the +Z direction side.

As shown in FIGS. 2 and 3, the cable connection structural body 11 includes a cable holding portion 11A that extends in the Y direction and has a concave shape opening in the −Z direction, and a pair of ground line connection portions 11B that are disposed adjacently to the cable holding portion 11A separately on the +X and −X direction sides, extend in the Y direction and has a concave shape opening in the +Z direction.

On the −Y direction side of the pair of ground line connection portions 11B, a pair of substrate fixation portions 11C project to extend in the −Z direction separately from the +X and −X directional ends of the cable holding portion 11A.

The cable connection structural body 11 further includes a hollow bundling portion 11D joined to the −Y directional end of the cable holding portion 11A. The bundling portion 11D has an outline shape formed by connecting two semicircles having the same radius with common external tangents, i.e., a shape of a track for athletics, when viewed in the Y direction.

The cable connection structural body 11 is made of a conductive material and may be produced by bending a single metal plate.

As shown in FIG. 4, the multi-core cable 21 has a structure in which four signal lines 22 are covered by a shield braid 23, and the outer periphery of the shield braid 23 is covered by a sheath 24. At the tip of the multi-core cable 21, the sheath 24 is removed by a predetermined length and the shield braid 23 is folded back on the outer periphery of the sheath 24 such that the four signal lines 22 are exposed from the sheath 24 and the shield braid 23 to project in the +Y direction.

Each of the signal lines 22 is composed of a coaxial line for high-speed transmission having the structure in which an insulator 22B is disposed on the outer periphery of a central conductor 22A and a plurality of shield lines (not shown) are wound around the outer periphery of the insulator 22B for the purpose of impedance control. Of the four signal lines 22, shield lines of two signal lines 22 are loosened and thereafter twisted together to form one ground line 25 while shield lines of the remaining two signal lines are loosened and thereafter twisted together to form another ground line 25. Each ground line 25 is covered by an insulating shrinkable tube 26 and provided at its tip portion with an auxiliary soldering portion 27. At the tip portion of each of the signal lines 22, the insulator 22B is removed by a predetermined length such that the central conductor 22A is exposed.

As shown in FIG. 5, the substrate 31 has a flat plate shape extending in the XY plane, and four signal electrodes 31A are aligned in the X direction on the surface of the substrate 31 facing in the +Z direction. On the surface of the substrate 31 facing in the +Z direction, ground electrodes 31B are formed farther in the −Y direction than the four signal electrodes 31A separately in the vicinity of the +X and −X directional ends of the substrate 31.

Recesses 31C, which are cutouts at the +X and −X directional ends of the substrate 31, are formed in the vicinity of the −Y directional end of the substrate 31, and ground electrodes 31D are also formed at respective portions surrounding the recesses 31C on the surface of the substrate 31 facing in the +Z direction.

Now the method of connecting the multi-core cable 21 to the substrate 31 is described. It is assumed that in the multi-core cable 21, the four signal lines 22 and the two ground lines 25 project in the +Y direction from the sheath 24 and the shield braid 23, the central conductor 22A is exposed from the insulator 22B at the tip portion of each of the signal lines 22, and the auxiliary soldering portion 27 is formed at the tip portion of each of the ground lines 25, as shown in FIG. 4.

First, the four signal lines 22 of the multi-core cable 21 are passed through the bundling portion 11D of the cable connection structural body 11, and the tip portions of the signal lines 22 are allowed to project from the cable connection structural body 11 through the concave-shaped cable holding portion 11A of the cable connection structural body 11. At this time, the multi-core cable 21 is positioned such that the portions of the signal lines 22 covered by the insulators 22B lie inside the cable holding portion 11A of the cable connection structural body 11 and the central conductors 22A exposed from the insulators 22B lie outside the cable connection structural body 11.

The bundling portion 11D of the cable connection structural body 11 has a shape and size suitable for allowing the laterally-aligned four signal lines 22 to be passed therethrough. The four signal lines 22 are passed through the bundling portion 11D of the cable connection structural body 11 to be surrounded by the bundling portion 11D so that the signal lines 22 are bundled together.

Next, as shown in FIG. 6, the cable connection structural body 11 is placed on the surface of the substrate 31 facing in the +Z direction, and the pair of substrate fixation portions 11C of the cable connection structural body 11 are separately fitted in the corresponding recesses 31C of the substrate 31. Thus, the cable connection structural body 11 is positioned with respect to the substrate 31, and +Y directional ends of the pair of ground line connection portions 11B of the cable connection structural body 11 are placed immediately above the corresponding ground electrodes 31B of the substrate 31.

Then, the pair of substrate fixation portions 11C of the cable connection structural body 11 are connected to the corresponding ground electrodes 31D of the substrate 31 by soldering, and the pair of ground line connection portions 11B of the cable connection structural body 11 are connected to the corresponding ground electrodes 31B of the substrate 31 by soldering. As a result, the cable connection structural body 11 is mechanically fixed to the substrate 31 and electrically connected to the ground electrodes 31B and 31D of the substrate 31.

The two ground lines 25 of the multi-core cable 21 are not shown in FIG. 6 in order to provide a clear view of the cable connection structural body 11 fixed to the substrate 31.

As is seen in FIG. 7, by fixing the cable connection structural body 11 to the substrate 31, a space S is formed between the concave-shaped cable holding portion 11A of the cable connection structural body 11 and the surface of the substrate 31, and the portions of the four signal lines 22 covered by the insulator 22B are located in the space S and sandwiched between the cable holding portion 11A and the surface of the substrate 31. Thus, the four signal lines 22 of the multi-core cable 21 are positioned with respect to the substrate 31 in the X and Z directions.

Further, the position of the multi-core cable 21 is adjusted in the Y direction with respect to the substrate 31 so as to place the exposed central conductors 22A of the four signal lines 22 immediately above the corresponding signal electrodes 31A of the substrate 31 and place the auxiliary soldering portions 27 of the two ground lines 25 of the multi-core cable 21 immediately above the corresponding ground line connection portions 11B of the cable connection structural body 11. In this state, the central conductors 22A of the four signal lines 22 are separately connected to the four signal electrodes 31A of the substrate 31 by soldering, and the auxiliary soldering portions 27 of the two ground lines 25 are separately connected to the two ground line connection portions 11B of the cable connection structural body 11 by soldering, whereby the cable connection structure shown in FIG. 1 is obtained.

The ground line connection portions 11D of the cable connection structural body 11 have a concave shape opening in the direction away from the surface of the substrate 31, that is, in the +Z direction when the substrate fixation portions 11C are fixed to the substrate 31, and therefore, the auxiliary soldering portions 27 of the ground lines 25 are readily positioned and stabilized above the ground line connection portions 11B, which facilitates a solder connection process.

Figure 8:
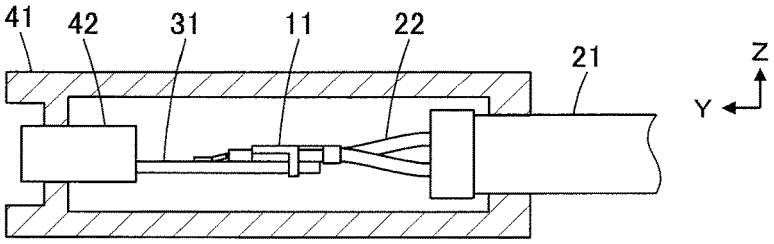
FIG. 8 is a side view showing a cable connector using the cable connection structural body according to Embodiment 1 with a connector housing being partially cut away.

This cable connection structure is applicable to, for instance, a cable connector as shown in FIG. 8.

The cable connector of FIG. 8 has a connector housing 41 attached to the tip of the multi-core cable 21. The connector housing 41 accommodates the substrate 31 therein, and the signal lines 22 and the ground lines (not shown) of the multi-core cable 21 are connected to the substrate 31 using the cable connection structural body 11.

The ground lines 25 of the multi-core cable 21 are not shown in FIG. 8 in order to provide a clear view of the cable connection structural body 11 fixed to the substrate 31.

A connection portion 42 connected to the substrate 31 is disposed in the connector housing 41. The connection portion 42 comes into contact with a connection portion of a counter connector (not shown) to establish electric connection therewith when the cable connector is fitted with the counter connector. The connection portion 42 may comprise a contact mounted on the substrate 31 or may be composed of a conductor layer formed on the surface of the substrate 31.

The use of the cable connection structural body 11 makes it possible to easily produce the cable connector in which the multi-core cable 21 is connected to the substrate 31 in the connector housing 41.

As described above, the use of the cable connection structural body 11 makes it possible to connect the central conductors 22A of the four signal lines 22 of the multi-core cable 21 to the four signal electrodes 31A of the substrate 31 by soldering with the four signal lines 22 being positioned with respect to the substrate 31, and thus easy connection of the multi-core cable 21 is achieved while preventing misalignment of the signal lines 22.

Since the cable connection structural body 11 has the ground line connection portions 11B in a concave shape opening in the +Z direction, only by connecting the ground lines 25, which are formed by twisting the impedance-controlling shield lines of the signal lines 22, to the ground line connection portions 11B, the ground lines 25 are to be electrically connected to the ground electrodes 31B and 31D of the substrate 31 via the cable connection structural body 11 made of a conductive material. In other words, the connection of the ground lines 25 can be easily carried out even though the substrate 31 does not have electrodes to which the ground lines 25 are directly connected.

Among the four signal lines 22 of the multi-core cable 21, the shield lines of every two signal lines 22 are twisted together and as a result the two ground lines 25 are formed. Therefore, the number of ground line connection portions 11B formed in the cable connection structural body 11 is smaller than the number of the signal lines 22, which allows the cable connection structural body 11 to be compact.

As the auxiliary soldering portion 27 formed at the tip portion of the ground line 25 increases in length, the flexibility of the tip portion of the ground line 25 would decrease accordingly. However, since the ground line 25 is covered by the shrinkable tube 26 and the auxiliary soldering portion 27 is formed in the position closer to the tip of the ground line 25 than the position of the shrinkable tube 26, the shrinkable tube 26 limits the length of the auxiliary soldering portion 27, thus facilitating a solder connection process.

Since the cable connection structural body 11 has the bundling portion 11D that surrounds the periphery of the four signal lines 22 of the multi-core cable 21 to bundle these signal lines 22, the plural signal lines 22 can be collectively disposed, which improves work efficiency in a process for connecting the multi-core cable 21 to the substrate 31.

As shown in FIG. 6, the cable connection structural body 11 is configured such that, when positioned with respect to the substrate 31, the bundling portion 11D comes to a position deviated toward the −Y direction side from the substrate 31. Such a configuration prevents a height difference between the signal lines 22 and the signal electrodes 31A of the substrate 31 due to a metal plate that forms the bundling portion 11D entering between the signal lines 22 and the surface of the substrate 31 from occurring, thus facilitating a process for connecting the signal lines 22 to the signal electrodes 31A.

Since the shield lines of the respective signal lines 22 are loosened and the portions where the insulators 22B covering the central conductors 22A are exposed are laterally aligned in the cable holding portion 11A of the cable connection structural body 11, which leads to a narrower arrangement pitch of the signal lines 22, thus achieving compact cable connection structure.

While in Embodiment 1 above, the multi-core cable 21 has the four signal lines 22, the invention is not limited thereto and the cable connection structural body 11 can be widely used for connection of multi-core cables each having two or more signal lines. It is preferable, however, that the cable holding portion 11A and the bundling portion 11D be formed to have sizes corresponding to the diameter and the number of the signal lines of the multi-core cable to be connected.

In addition, while in Embodiment 1 above, among the four signal lines 22 of the multi-core cable 21, the shield lines of every two signal lines 22 are twisted together and as a result the two ground lines 25 are formed, the invention is not limited thereto. For instance, all shield lines of plural signal lines may be twisted together to form a single ground line. In this case, the cable connection structural body 11 does not need to have the pair of ground line connection portions 11B, and the single ground line may be connected by soldering to a single ground line connection portion 11B disposed solely on one side of the cable holding portion 11A.

Embodiment 2

Figure 9:
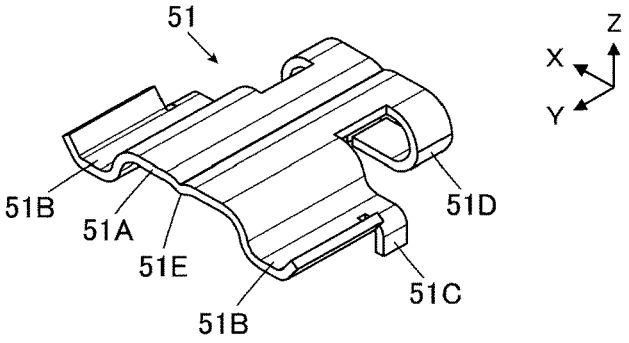
FIG. 9 is a perspective view showing a cable connection structural body according to Embodiment 2.

FIG. 9 shows a cable connection structural body 51 according to Embodiment 2. Similarly to the cable connection structural body 11 of Embodiment 1 as shown in FIGS. 2 and 3, the cable connection structural body 51 includes a cable holding portion 51A in a concave shape that opens in the −Z direction, a pair of ground line connection portions 51B that are disposed adjacently to the cable holding portion 51A separately on the +X and −X direction sides and has a concave shape opening in the +Z direction, a pair of substrate fixation portions 51C that extend in the −Z direction separately from the +X and −X directional ends of the cable holding portion 51A, and a hollow bundling portion 51D joined to the −Y directional end of the cable holding portion 51A.

Figure 10:
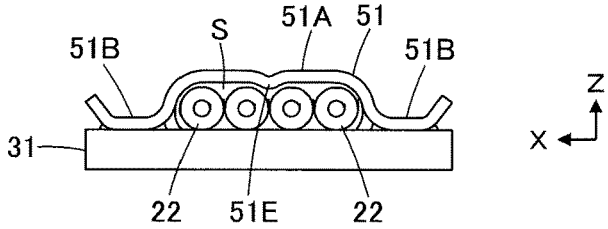
FIG. 10 is a front view showing the state where the signal lines of the multi-core cable are passed between a cable holding portion of the cable connection structural body according to Embodiment 2 and the substrate.

The cable connection structural body 51 is, however, different from the cable connection structural body 11 in that the cable connection structural body 51 has one protruding portion 51E that extends in the Y direction from the cable holding portion 51A to the bundling portion 51D and protrudes in the −Z direction. The protruding portion 51E has a protrusion height that allows a gap between the protruding portion 51E and the surface of the substrate 31 to be smaller than the diameter of the signal lines 22 when the cable connection structural body 51 is fixed to the substrate 31, as shown in FIG. 10.

When the cable connection structural body 51 is fixed to the substrate 31, a space S is formed between the cable holding portion 51A of the cable connection structural body 51 and the surface of the substrate 31, and the four signal lines 22 are disposed in the space S and sandwiched between the cable holding portion 51A and the surface of the substrate 31. At this time, of the laterally-aligned four signal lines 22, the adjacent two signal lines 22 lying in the center are separated from each other by the protruding portion 51E formed in the cable connection structural body 51, and a gap smaller than the diameter of the signal lines 22 is formed between the protruding portion 51E and the surface of the substrate 31. Accordingly, the space S is divided into two spaces with the protruding portion 51E serving as the boundary, and two signal lines 22 are accommodated in each of the two spaces, thus making it possible to perform accurate positioning of the four signal lines 22.

The number of the protruding portion 51E is not necessarily one, and the cable connection structural body 51 may have two or more protruding portions 51E. In such cases, the space S, which is formed between the cable holding portion 51A and the surface of the substrate 31 when the cable connection structural body 51 is fixed to the substrate 31, is divided into three or more spaces, and the signal lines 22 are to be separately accommodated in the respective spaces.

In addition, the number of the signal lines 22 accommodated in each of spaces formed by dividing the space S by the protruding portion(s) 51E is not necessarily two. For instance, for the four signal lines 22, the space S may be divided into four spaces by three protruding portions 51E such that the signal lines 22 are accommodated in the four spaces one by one.

Embodiment 3

Figure 11:
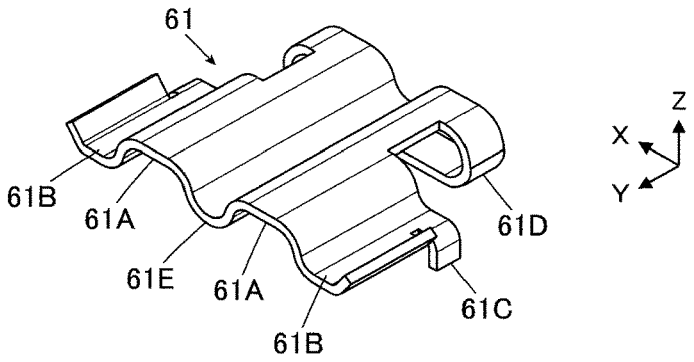
FIG. 11 is a perspective view showing a cable connection structural body according to Embodiment 3.

FIG. 11 shows a cable connection structural body 61 according to Embodiment 3. The cable connection structural body 61 includes a pair of cable holding portions 61A that lie adjacently to each other via a protruding portion 61E and has a concave shape opening in the −Z direction, a pair of ground line connection portions 61B that are separately disposed adjacently to the outer sides of the respective cable holding portions 61A and has a concave shape opening in the +Z direction, a pair of substrate fixation portions 61C that extend toward the −Z direction, and a hollow bundling portion 61D joined to the pair of cable holding portions 61A.

Figure 12:
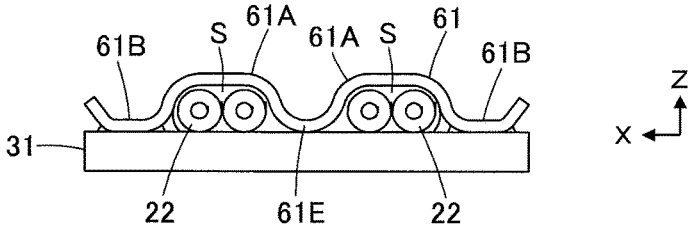
FIG. 12 is a front view showing the state where the signal lines of the multi-core cable are passed between a cable holding portion of the cable connection structural body according to Embodiment 3 and the substrate.
Figure 13:
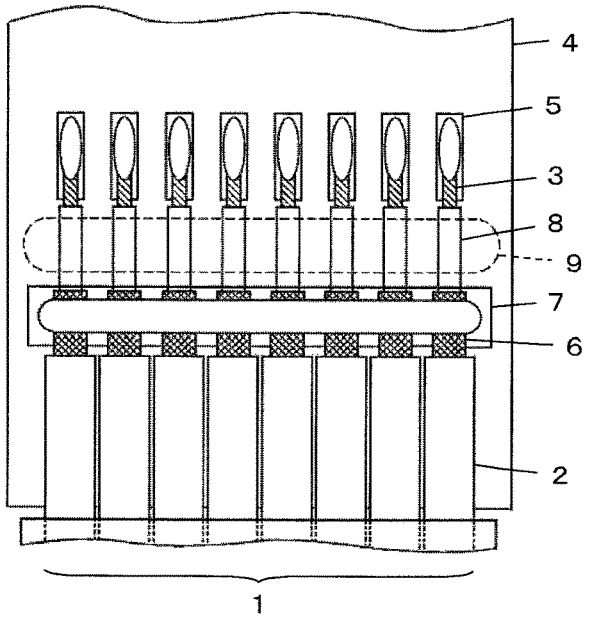
FIG. 13 PRIOR ART
FIG. 13 is a plan view showing a conventional cable connection structure.

As shown in FIG. 12, the protruding portion 61E has a protrusion height that allows the portion 61E to come into contact with the surface of the substrate 31 when the cable connection structural body 61 is fixed to the substrate 31.

In other words, the cable connection structural body 61 is obtained by increasing the protrusion height of the protruding portion 51E that separates the adjacent two signal lines 22 in the cable connection structural body 51 of Embodiment 2 shown in FIG. 9. Since the cable connection structural body 61 has the protruding portion 61E with a protrusion height that allows the portion 61E to come into contact with the surface of the substrate 31, the two cable holding portions 61A are formed on the opposite sides of the protruding portion 61E.

As shown in FIG. 12, when the cable connection structural body 61 is fixed to the substrate 31, two spaces S are formed between the two cable holding portions 61A of the cable connection structural body 61 and the surface of the substrate 31, and two signal lines 22 are accommodated in each space S and sandwiched between the cable holding portions 61A and the surface of the substrate 31. Thus, it is possible to perform accurate positioning of the four signal lines 22.

In addition, in the cable connection structural body 61 according to Embodiment 3, since the protruding portion 61E having a protrusion height that allows the portion 61E to come into contact with the surface of the substrate 31 is present between the two spaces S, when the cable connection structural body 61 is formed of a conductive material, two signal lines 22 accommodated in one space S and two signal lines 22 accommodated in the other space S are electromagnetically shielded from each other by the portion 61E.

This configuration makes it possible to suppress crosstalk that may occur between two signal lines 22 accommodated in one of the spaces S and the other two signal lines 22 accommodated in the other of the spaces S.

In the cable connection structural body 61 shown in FIG. 11, the protruding portion 61E extends up to the bundling portion 61D and the inside of the bundling portion 61D is divided into two by the protruding portion 61E. Therefore, the four signal lines 22 can also be divided into two groups of two each by the protruding portion 61E and separately bound up in the bundling portion 61D, whereupon the two signal line groups are electromagnetically shielded from each other by the protruding portion 61E therebetween.

The number of the protruding portion 61E is not necessarily one, and the cable connection structural body 61 may have two or more protruding portions 61E. In such cases, the cable connection structural body 61 is to have three or more cable holding portions 61A, which allows the signal lines 22 to be separately accommodated in the spaces S formed between the respective cable holding portions 61A and the surface of the substrate 31.

In addition, the number of the signal lines 22 accommodated in each of the spaces S is not necessarily two and may be one or three or more.

In Embodiments 1 to 3 above, when the ground lines 25 of the multi-core cable 21 need not be electrically connected to the ground electrodes 31B or 31D of the substrate 31, or when a multi-core cable with no ground line is connected, the cable connection structural bodies 11, 51 and 61 may each be formed of not a conductive material but an insulating material such as an insulating resin. Even with any of the cable connection structural bodies 11, 51 and 61 made of an insulating material, it is possible to easily connect a multi-core cable while preventing misalignment of plural signal lines of the multi-core cable.

What is claimed is:

1. A cable connection structural body that is used for connecting a multi-core cable having a plurality of signal lines to a substrate, the cable connection structural body comprising:

a substrate fixation portion that is fixed to the substrate;

a hollow bundling portion that surrounds the plurality of signal lines exposed from a sheath of the multi-core cable and passed therethrough to bundle the plurality of signal lines; and a signal lines holding portion that forms a space passing only the plurality of signal lines passed through the hollow bundling portion between the signal lines holding portion and a surface of the substrate when the substrate fixation portion is fixed to the substrate;

wherein each of the plurality of signal lines has a central conductor and an insulator that covers an outer periphery of the central conductor, wherein the hollow bundling portion bundles the plurality of signal lines, each of which is covered by the insulator, wherein the signal lines holding portion sandwiches and holds the plurality of signal lines, which are passed through the space and each of which is covered by the insulator, between the signal lines holding portion and the surface of the substrate to position the plurality of signal lines with respect to the substrate.

2. The cable connection structural body according to claim 1, wherein the central conductor of each of the plurality of signal lines is connected to one of a plurality of signal electrodes disposed on the substrate.

3. The cable connection structural body according to claim 1, wherein the cable connection structural body is made of a conductive material.

4. The cable connection structural body according to claim 3, wherein the cable connection structural body is connected to a ground electrode disposed on the substrate.

5. The cable connection structural body according to claim 4, further comprising:

a ground line connection portion which is disposed adjacently to the signal lines holding portion and to which a ground line of the multi-core cable is connected.

6. The cable connection structural body according to claim 5, wherein the ground line connection portion is disposed on each of opposite sides of the signal lines holding portion.

7. The cable connection structural body according to claim 5, wherein the ground line connection portion has a concave shape opening in a direction away from the surface of the substrate when the substrate fixation portion is fixed to the substrate.

8. The cable connection structural body according to claim 3, wherein the signal lines holding portion has at least one protruding portion that separates adjacent two of the plurality of signal lines in order to perform positioning of the plurality of signal lines passed through the space.

9. The cable connection structural body according to claim 8, wherein the protruding portion electromagnetically shields the adjacent two of the plurality of signal lines from each other.

10. The cable connection structural body according to claim 1, wherein the cable connection structural body is formed of a single metal plate.

11. A cable connector comprising the cable connection structural body according to claim 1.

12. The cable connection structural body according to claim 1, wherein the substrate fixation portion projects toward the substrate and is fitted in a recess of the substrate to be fixed to the substrate.

* * * * *